US010362883B1

(12) United States Patent
Bellini

(10) Patent No.: US 10,362,883 B1
(45) Date of Patent: Jul. 30, 2019

(54) UNITARY, CONTINUOUS AND LINEAR APPARATUS HAVING DUAL FUNCTIONALITY FOR TRANSPORTING AND SECURING COVER TO A SEATING OR RESTING DEVICE

(71) Applicant: Leann L Bellini, Dixon, IL (US)

(72) Inventor: Leann L Bellini, Dixon, IL (US)

(73) Assignee: Leann L. Bellini, Dixon, IL (US)

( * ) Notice: Subject to any disclaimer, the term of this patent is extended or adjusted under 35 U.S.C. 154(b) by 107 days.

(21) Appl. No.: 15/438,586

(22) Filed: Feb. 21, 2017

(51) Int. Cl.
*A45F 4/00* (2006.01)
*A47C 31/11* (2006.01)
*A45F 3/14* (2006.01)
*A47C 1/14* (2006.01)

(52) U.S. Cl.
CPC ..... *A47C 31/11* (2013.01); *A45F 3/14* (2013.01); *A45F 4/00* (2013.01); *A47C 1/14* (2013.01); *A47C 1/143* (2013.01); *A45F 2003/142* (2013.01); *A45F 2004/006* (2013.01)

(58) Field of Classification Search
CPC ... A47C 31/11; A61F 5/40; A45F 5/00; A45F 3/00; A44B 18/00; A44B 13/00
USPC ..... 224/577, 224, 148
See application file for complete search history.

(56) References Cited

U.S. PATENT DOCUMENTS 3,921,871 A * 11/1975 Heil ..... A63C 11/027 220/8
4,097,086 A * 6/1978 Hudson ..... B60N 2/882 297/217.1
4,220,302 A * 9/1980 Hampton ..... A61J 9/0676 224/148.6
4,337,938 A * 7/1982 Rodriguez ..... A63B 69/0059 224/258
4,483,380 A * 11/1984 Beran ..... A45C 3/00 206/315.1
4,646,397 A * 3/1987 Yoshida ..... A44B 18/0069 24/442
4,654,246 A * 3/1987 Provost ..... A41F 1/00 26/2 R
4,666,207 A * 5/1987 Quartano ..... B62B 3/144 280/33.992

(Continued)

FOREIGN PATENT DOCUMENTS

EP 2689694 A1 7/2012
EP 2474462 A2 11/2012

OTHER PUBLICATIONS

The Towel Trap. Towel Trap Inc, 1998 [retrieved on Sep. 22, 2016]. Retrieved from the Internet: <URL: http://www.toweltrap.com>.

(Continued)

*Primary Examiner* — Brian D Nash
(74) *Attorney, Agent, or Firm* — Jack W. Trexler, Jr.

(57) ABSTRACT

A unitary and continuous linear apparatus having dual fastening means for providing hands-free transporting of a cover to a destination having a seating or resting device. The apparatus is also adaptable to be removably mounted on the seating or resting device for securing the cover from being displaced. The continuous liner apparatus is of modular design and can be adapted for providing a securing pad having the advantages of being easily stored, easily clean, and containing storage for personal items. Moreover, the modularity also provides for disassemble for cleaning and storage.

5 Claims, 8 Drawing Sheets

(56) References Cited

U.S. PATENT DOCUMENTS 4,725,094 A 2/1988 Greer
4,751,923 A * 6/1988 Marino ..... A61F 5/3738 128/878
4,804,025 A * 2/1989 Bear ..... A45F 3/14 224/258
4,858,801 A * 8/1989 Sameniego ..... A45C 13/30 224/264
4,911,347 A * 3/1990 Wilhite ..... A45F 3/14 224/251
4,934,540 A 6/1990 Novak
4,982,885 A * 1/1991 Severson ..... A45C 13/30 224/250
5,060,835 A * 10/1991 Payne ..... A45C 1/04 224/148.2
5,136,759 A * 8/1992 Armour, II ..... A44B 18/00 24/16 R
D332,663 S * 1/1993 Liszewski ..... D24/190
5,231,738 A * 8/1993 Higashinaka ..... A44B 18/003 24/446
5,240,158 A * 8/1993 Walsh ..... A41F 9/002 224/148.6
5,240,330 A * 8/1993 Thompson ..... A45C 9/00 224/577
D342,381 S * 12/1993 Brink ..... D3/259
D342,563 S * 12/1993 Tukiendorf ..... D3/259
5,275,463 A * 1/1994 Rocha ..... A47C 31/11 297/188.01
5,294,171 A * 3/1994 Horng ..... A47C 1/143 297/220
5,318,209 A * 6/1994 Rader ..... A45F 3/14 224/250
5,345,633 A * 9/1994 Harnish ..... B60N 2/879 5/639
5,369,853 A * 12/1994 Okawa ..... A44B 18/003 24/446
5,399,418 A * 3/1995 Hartmanns ..... B64G 6/00 139/420 R
5,427,291 A * 6/1995 Smith ..... A63C 11/025 224/250
5,441,789 A * 8/1995 Walker ..... A47C 1/143 297/223
5,450,995 A * 9/1995 Perrin ..... A45C 13/30 224/254
5,460,308 A * 10/1995 Hahn ..... A45F 3/14 224/250
5,503,456 A 4/1996 Rossini
5,584,456 A 12/1996 Stephens
5,603,545 A * 2/1997 Benson ..... A45F 3/14 224/250
D382,431 S * 8/1997 Parra ..... D6/546
D400,100 S 10/1998 Minard
5,829,832 A 11/1998 Molee
5,954,254 A * 9/1999 Maeng ..... A63B 55/408 206/315.3
6,135,635 A * 10/2000 Miller ..... A45F 4/02 224/584
6,149,234 A 11/2000 Daniels
6,189,968 B1 2/2001 Emanuel
D457,725 S * 5/2002 Parsons ..... D3/327
6,381,812 B1 5/2002 Crider
6,435,617 B1 * 8/2002 McNair ..... B60N 2/882 297/397
D463,325 S 9/2002 Savola
6,471,105 B1 * 10/2002 Ammerman ..... A45C 13/30 150/110
6,484,335 B2 11/2002 Gilbert
6,575,533 B1 6/2003 Kicos
6,624,346 B2 * 9/2003 Standish ..... G10G 5/005 84/280
6,728,998 B2 5/2004 Wang
7,097,244 B2 * 8/2006 Holmgren ..... B60N 2/2809 297/219.12
D556,562 S 12/2007 Seifert
7,905,039 B2 3/2011 Karovic
7,927,311 B1 * 4/2011 Bachelder ..... A45F 5/00 224/148.4
7,971,763 B2 * 7/2011 Chace ..... A45F 5/14 224/153
D686,025 S * 7/2013 Blazure ..... D6/601
9,332,858 B1 5/2016 Chiang
D784,692 S * 4/2017 Sandorffy ..... D3/254
2010/0001565 A1 1/2010 Gray
2011/0047697 A1 3/2011 McBrearty
2012/0242126 A1 9/2012 Burns
2016/0338504 A1 11/2016 Bellini

OTHER PUBLICATIONS

The Beach Chair Buddy_Feb. 19, 2015, 2015 [retrieved on May 16, 2017]. Retrieved from the Internet: <URL: https://web.archive.org/web/20150219145119/www.beachchairbuddy.com>.

The Beach Chair Buddy_Trademark Electronic Search System (TESS), May 14, 2013 Retrieved on May 16, 2017 from the Internet: <URL: http://tmsearch.uspto.gov/bin/showfield?f=doc&state=4807:89q1dy.2.1>.

* cited by examiner

UNITARY, CONTINUOUS AND LINEAR APPARATUS HAVING DUAL FUNCTIONALITY FOR TRANSPORTING AND SECURING COVER TO A SEATING OR RESTING DEVICE

FIELD OF THE INVENTION

The present invention relates to transporting and securing structures and more particularly pertains to an apparatus for transporting and securing a cover (e.g., a towel) on a seating or resting device (e.g., beach and pool chairs and chaises).

BACKGROUND

The following is a tabulation of some prior art that presently appears relevant:

| U.S. Patents | | | |
|---|---|---|---|
| Pat. No. | Kind Code | Issue Date | Patentee |
| U.S. 5,503,456 | A | 1996 Apr. 02 | Rossini |
| U.S. 6,149,234 | A | 2000 Nov. 21 | Daniels |
| U.S. 6,575,533 | B1 | 2003 Jun. 10 | Kicos |
| U.S. 6,484,335 | B2 | 2002 Nov. 26 | Gilbert |
| U.S. 7,905,039 | B2 | 2011 Mar. 15 | Karovic, et al |
| U.S. 6,189,968 | B1 | 2001 Feb. 20 | Emanuel et al |
| U.S. D556562 | S1 | 2007 Dec. 04 | Seifert et al |
| U.S. D463325 | S | 2002 Sep. 24 | Savola |
| U.S. 4,934,540 | A | 1990 Jun. 19 | Novak |
| U.S. 5,829,832 | A | 1998 Nov. 03 | Molee |
| U.S. 5,584,456 | A | 1996 Dec. 17 | Stephens |
| U.S. 6,728,998 | B2 | 2004 May 04 | Wang et al |
| U.S. D400100 | A | 1988 Oct. 27 | Minard |
| U.S. 4,725,094 | A | 1988 Feb. 16 | Greer |
| U.S. 9,332,858 | B1 | 2010 May 10 | Chiang et al |
| U.S. 6,381,812 | B1 | 2002 May 07 | Crider et al |

| U.S. Patent Application Publications | | | |
|---|---|---|---|
| Pat. No. | Kind Code | Publication Date | Patentee |
| U.S. 20120242126 | A1 | 2012 Sep. 27 | Burns |
| U.S. 20100001565 | A1 | 2010 Jan. 07 | Gray et al |
| U.S. 20110047697 | A1 | 2011 Mar. 03 | McBrearty |

| Foreign Patent Documents | | | | |
|---|---|---|---|---|
| Foreign Document Number | Country Code | Kind Code | Publication Date | Patentee |
| EP2474462 | CH | A2 | 2012 Nov. 07 | Hubert |
| EP2689694 | GB | A1 | 2012 Jul. 24 | Smith |

| Nonpatent Literature documents |
|---|
| The Towel Trap. Towel Trap Inc, 1998 [retrieved on 2016 Sep. 22]. Retrieved from the Internet: <URL: http://www.toweltrap.com>. |

Use of beach and pool lounge chairs and chaises (a.k.a., "seating or resting devices" or "chairs") on beaches, boat decks, near swimming pools, lawns, and other outdoor environments generally require the occupant bring a cover (e.g., personal towel or personal beach towel) for mounting over the chair to provide a more comfortable environment in which to relax, to avoid the tacky feeling of plastic or the harsh feeling of wood, and to absorb any perspiration or dripping water. However, when the chair is not occupied, wind gusts may blow the cover from the chair, or crumple it on the chair, requiring the cover to be realigned. Additionally, just the act of getting out of the chair, or moving around in the chair, can cause the cover to shift or be disarranged to the point the cover falls from the chair.

Known structures in the art directed to securing the cover to the seating or resting device are of two general designs:

a. mechanical clamping (see, for example, U.S. Pat. Nos. 4,934,540, 5,829,832, 5,584,456) and
b. strapping, wherein structures of strapping designs are:
   i. non-continuous strap (see, for example, USD463325, EP2474462) and
   ii. closed-loop strap (see, for example, U.S. Pat. Nos. 5,503,456, 6,149,234, 6,575,533, 7,905,039. U.S. Pat. No. 6,189,968, USD556562, EP2689694).

The known structures of closed-loop design are either: (i) permanent closed-loop strap or (ii) non-permanent closed-loop strap wherein the strap includes a releasable coupler (e.g., buckle) for temporarily configuring the strap into a continuous closed-loop for placing around the cover and the seating or resting device.

As exemplified above, a variety of devices have been disclosed offering various levels of efficiency with respect to securing a cover to a seating or resting device, however these devices do not provide a versatile, hand-free feature for facilitating the transportation of the cover and personal items to the location of use (i.e., to the seating or resting device). To overcome the transporting burden associated with known structures, an additional containment device (e.g., tote bag) is typically required to transport the cover and personal items to the seating or resting device. In conclusion, there is no single known simple, economical, and practical apparatus for securing a cover to a seating and also capable of providing hands-free transporting of the cover to the resting or seating device.

SUMMARY

One embodiment of the present invention is an apparatus for transporting a cover 112 and for securing the cover 112 to a seating or resting device 114. The apparatus 110 includes: (i) a linear strap 116 being one-piece, integral, and unitary construction; (ii) a first fastening means 120L; (ii) a second fastening means 120R; and a variable coupling means 118. The first fastening means and a second fastening means being used to configuring two variable sized closed loops. The first closed-loop being used to retain the cover in a rolled-up configuration and the second closed-loop being used as an arm- or shoulder-sling for hands-free transporting of the rolled-up cover. The variable coupling means is used to configure the apparatus into a third closed-loop wherein the apparatus is adaptable to and can be removably mounted on the seating or resting device.

In another embodiment, the linear strap 116 of the apparatus 110 includes a stabilizing pad 116M to enhance the apparatus in securing the cover to the seat or resting device. The stabilizing pad further provides or additional features such as batting, quilting, printing, and pockets for storing personal items.

In another embodiment, the present invention provides a method for transporting a cover 112 and securing said cover to a seating or resting device 114. The method includes placing the apparatus on a surface, rolling up the cover and any personal items within the cover, placing the rolled-up cover on the stabilizing pad of the apparatus, rolling the stabilizing pad 116M of the apparatus around the cover, tautly wrapping a left strap 116L around the cover, engaging the hook 124 of the first fastening means 120L with the loop 126 of the left strap 116L to secure the cover in a rolled up configuration, and forming a second closed-loop sized for placing over the arm or the shoulder by engaging the hook 124 of the second fastening means 120R with the loop 126 of the right strap 116R, and inserting the arm or the shoulder the closed-loop.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description, therefore, is not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention.

DRAWINGS—FIGURES

Figure 1A:
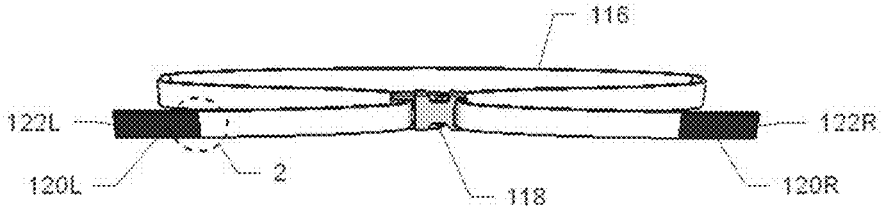

1A Perspective view of apparatus 110 showing linear strap 116, fastening means 120L & 120R, and variable coupling means 118.

1B Perspective view of apparatus 110 configured around rolled-up cover 112 for transporting

1C Perspective view of apparatus 110 configured for securing cover 112 mounted on seating or resting device 114

2 Enlarged view of linear strap 116 and fastening means 120L

3 Perspective view of Ladder-Lock Buckle

4 Perspective view of Adjustably Releasable Buckle

5 Perspective view of Linear Strap with Stabilizing Pad

6 Rear Perspective view of Stabilizing Pad

7 Rear Perspective view of Stabilizing Pad with Batting

8 Rear Perspective view of Stabilizing Pad with Outer Perimeter Securing Means

9 Rear Perspective view of Stabilizing Pad with Hem

10 Rear Perspective view of Stabilizing Pad with Welt

11 Rear Perspective view of Stabilizing Pad with Quilt

12 Rear Perspective view of Stabilizing Pad with Adhesive Layer

13 Perspective view of apparatus 110 configured with stabilization pad around rolled-up cover 112 for transporting

14 Rear Perspective view of Stabilizing Pad with Pocket

DRAWINGS—REFERENCE NUMBERS

110 Apparatus
112 Cover
114 Seating or Resting Device
116 Linear Strap
116L Left Strap
116M Stabilizing Pad
116R Right Strap
118 Variable Coupling Means
120L First Fastening Means
120R Second Fastening Means
122L First End
122R Second End
124 Hook
126 Loop
128 Fixed Aperture
130 First Stitching
132A Front Cinching Aperture
132B Rear Cinching Aperture
134A First Complimentary Component of Releasable Buckle
134B Second Complimentary Component of Releasable Buckle
136 Right Vertical Perimeter
138 Left Vertical Perimeter
140 Top Horizontal Perimeter
142 Bottom Horizontal Perimeter
144 Front Side
146 Rear Side
148 Top Layer
150 Bottom Layer
152 Single Ply Fabric Layer
154 Batting
162 Welt
164 Adhesive Layer
156 Outer Perimeter Securing Means
158 Outer Perimeter Area
160 Outer Perimeter Crease
168 First Quilt Skitch
170 Second Quilt Skitch
172 Strap-to-Pad Attachment Means
174 Pocket

DETAILED DESCRIPTION

The present invention may be understood more readily by reference to the following detailed description of preferred embodiments of the invention and the Examples included herein.

Before the present apparatus is disclosed and described, it is to be understood that this invention is not limited to a specific embodiment. It is also to be understood that the terminology used herein is for the purpose of describing particular embodiments only and is not intended to be limiting.

In this specification, the singular forms "a", "an" and "the" include plural referents unless the context clearly dictates otherwise.

General Embodiment

Figure 1B:
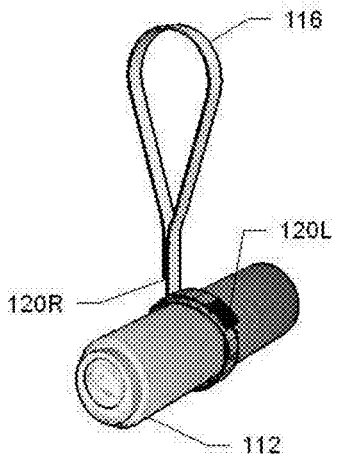
Figure 1C:
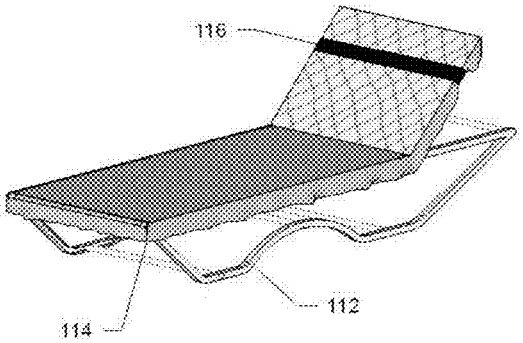

Referring now to FIGS. 1A, 1B, and 1C is illustrated an apparatus 110 (FIG. 1A), being of one-piece, integral, and unitary construction used for both the transportation of a cover 112 (FIG. 1B) and for the securing of the cover 112 on a seating or resting device 114. To facilitate transporting, the apparatus 110 can be simultaneously configured into two closed-loops (FIG. 1B), each being adjustable in size. A first closed-loop serves to secure the cover (e.g., towel) in a rolled-up configuration (along with personal items stored within the rolled-up towel) during transportation while a second closed-loop is adjustable adapted to serve as an arm or shoulder sling to facilitate hands-free transportation of the cover 112 while securing the cover in the rolled-up state. Additionally, the apparatus 110 is designed to be configured into a third closed-loop (FIGS. 1A and 1C) of variable size for securing the cover 112 when overlaid on the seating or resting device 114. Embodiments of the apparatus 110 are described below with references to the drawings, in which the same reference numerals will be applied to the same features of the apparatus 110 throughout the several drawings.

In one embodiment, the apparatus 110 (FIG. 1A) includes:

a linear strap 116, a first fastening means 120L for engaging a first end 122L of the linear strap 116 to the linear strap 116 to form the first closed-loop of variable size for securing the cover 112 during transportation (FIG. 1B), a second fastening means 120R for engaging a second end 122R of the linear strap 116 to the linear strap 116 to form the second closed loop of variable size for use as a hands-free transportation (FIG. 1B), and a variable coupling means 118 for configuring the linear strap 116 into the third closed-loop of variable size for securing said cover 112 disposed on the seating or resting device 114 (FIG. 1C).

Linear Strap 116

Of importance to the apparatus 110 is the unique construction of the linear strap 116 and the cooperative engagement interaction of the linear strap 116 with the first fastening means 120L and the second fastening means 120R positioned at a left free end 122L and a right free end 122R of the linear strap 116, respectively. In an embodiment, the linear strap 116 comprises a first complimentary fastening component (FIG. 2) and both the first fastening means 120L and the second fastening means 120R comprise a second complimentary fastening component; the first complimentary fastening component and the second complimentary component being complimentary releasable fastening components that releasable engage upon being pressed together. The first complimentary fastening component and the second complimentary fastening component comprise complimentary fastener components, for example, a male-to-female press-snap buttons, complimentary stem and mushroom fasteners (e.g., Dual Lock® by 3M), hook-and-loop fasteners (e.g., VELCRO®), and button-and-hole).

Figure 2:
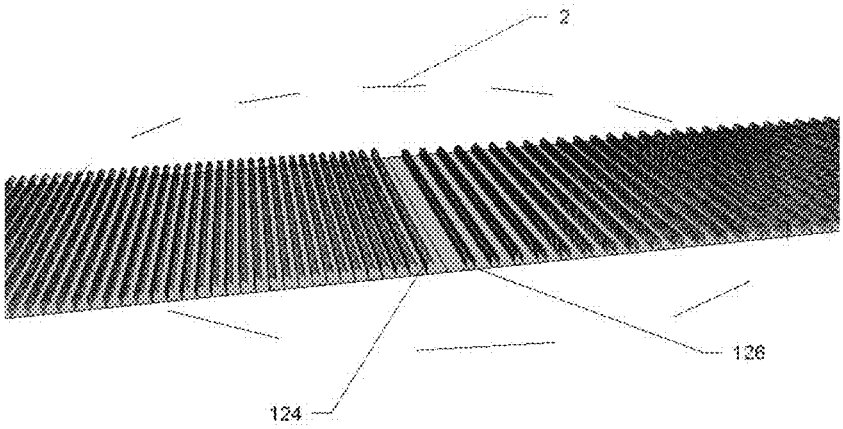

In one embodiment, the linear strap 116 comprises a first weave (a.k.a., a first web) of a first tightly woven synthetic fiber and a first loosely woven fiber interwoven with the first tightly woven synthetic fibers. The first loosely woven synthetic fiber extends (or loops) from the first web creating a loop 126 (FIG. 2). In this embodiment, the loop 126 is the first complimentary releasable fastening component and can be at one or more locations along the length of the linear strap 116.

In another embodiment, the linear strap 116 comprises nylon fibers, polyester fibers, polypropylene fibers, or a combination thereof. In yet another embodiment, the first loosely woven synthetic fiber of the linear strap 116 is elastic (a.k.a., resilient). In still another embodiment the linear strap 116 comprises elastic fibers (e.g., polypropylene) to provide elastic retention forces. In another embodiment, the linear strap 116 is of flat webbing type enabling the linear strap 116 to lie flat against the cover 112 and not be felt by the occupant of the seating or resting device 114.

The linear strap 116 has a length of about 40 inches to about 80 inches, or about 48 inches to about 72 inches, or about 56 inches to about 64 inches, or less than about 62 inches, or greater than about 52 inches. The linear strap 116 has a width of about 0.75 to about 2 inches, or about 0.5 inches to about 1.5 inches, or about 0.75 inches to about 1 inch. The linear strap 116 has a thickness of about 0.06 inches to 0.25 inches, or about 0.07 inches to about 0.18 inches, or about 0.09 inches to about 0.16 inches.

The First 122L and Second 122R Fastening Means

As set forth above, both the first fastening means 120L and the second fastening means 120R comprise the second complimentary component that releasable engage the linear strap 116 upon being pressed to the first complimentary component of the linear strap 116. The first complimentary fastening component and the second complimentary fastening component comprise complimentary releasable fastener components, for example, a male-to-female press-snap buttons, complimentary stem and mushroom fasteners (e.g., Dual Lock® by 3M), hook-and-loop fasteners (e.g., VELCRO®), and button-and-hole).

In an embodiment, the first fastening means 120L and the second fastening means 120R comprise a second weave (a.k.a., a second web) of a second tightly woven synthetic fiber and a second loosely woven fiber interwoven with the second tightly woven synthetic fibers. The second loosely woven synthetic fiber extends from the second web and is cut and/or heated, after weaving, to produce an array of a hook 124, projecting from the first fastening means 120L and the second fastening means 120R (FIG. 2), thus forming the second complimentary releasable fastening component. In this embodiment, the hook 124 of the first fastening means 120L and the hook 124 of the second fastening means 120R releasably engage the loop 126 of the linear strap 116 when the hook 124 and the loop 126 are pressed together. Engagement of the first fastening means 120L with the linear strap 116 (FIG. 1B) provides for formation of the first closed-loop for securing the cover 112 in a rolled-up state during transporting (or storage) whereas engagement of the second fastening means 120R with the linear strap 116 (FIG. 1B) provides for formation of the second closed-loop for hands-free transporting (e.g., arm or shoulder sling). One advantage of the embodiment is both the first fastening means 120L and the second fastening means 120R may be engaged at infinite location on the linear strap 116, thereby providing the first closed-loop and the second closed-loop to be variably adjusted for the desired size of the cover 112 and method of carrying (e.g., arm or shoulder sling), respectively.

The first fastening means 120L and the second fastening means 120R comprises nylon fibers, polyester fibers, polypropylene fibers, or a combination thereof. In one embodiment, the first fastening means 120L and the second fastening means 120R are of flat webbing type.

The embodiments are not limiting with respect to the to the first fastening means 120L and the second fastening means 120R being associated with first closed loop for securing the cover 112 in rolled up state and the second closed loop for the hands-free transporting (i.e., sling), but recognizes the first fastening means 120L and the second fastening means 120R may alternatively be associated with the first closed-loop being associated with the hands-free transporting sling (e.g., for sized for arm or shoulder) and the second loop with securing the cover 112 in a rolled up state wherein personal items may optionally be contained (i.e., wrapped or rolled within in the cover 112) during transportation or storage.

In an embodiment, a tab of the first fastening means 120L is attached to a first end 122L of the linear strap 116 and a tab of the second fastening means 120R is attached to a second end 122R of the linear strap 116. The term "tab" refers to, or defines, a round circle or a short area (e.g., square, elongated, or rectangle) having a width about the width of the linear strap 116 and a length of about 6 inches, or about 4 inches, or about 3 inches or about 2 inches, or about 1 inch. In another embodiment, the first fastening means 120L and the second fastening means 120R are permanently attached (e.g., sewn or bradded) to the linear strap 116.

In an embodiment, the linear strap 116 comprises an array of the loop 126 formed by warp yarns and the first fastening means 120L and the second fastening means 120R comprise an array of the hook 124 (a.k.a., pile) formed by warp yarns and, the array of the loop 126 and the hook 124 being separated in the warp direction of the first web and the second web, respectively. A self-engaged and releasable fastening of the loop 126 and the hook 124 gives rise to a co-acting grip between the hook 124 and the loop 126 when pressed together thereby giving rise to resistance in separation parallel to the interfacial plane of engagement, but are readily separable by peeling forces applied substantially normal to this interfacial plane. The term "interfacial plane of engagement", as used herein, refers to the area of attachment of the loop 126 of the linear strap 116 and the hook 124 of the first fastening means 120L and the second fastening means 120R.

Variable Coupling Means 118

In an embodiment, the apparatus 110 comprises the variable coupling means 118 (FIG. 1A) for longitudinally coupling the linear strap 116 into a third closed-loop for securing the cover 116 when mounted on the seating or resting device 114 (FIG. 1C). In one embodiment, the variable coupling means 118 comprises a ladder lock fastener (FIG. 3) to tautly mount the apparatus 110 to the seating or resting device 114. In this embodiment, the left end 122L (i.e., the left free end) of the linear strap 116 is threaded through a fixed aperture 128 of the ladder lock-loop buckle, positioning the ladder-lock buckle on the linear strap 116 at a position displaced linearly about 2 inches to about 16 inches from the first fastening means 120L toward the middle of the linear strap 116. The linear strap 116 is folded back on itself at the fixed aperture 128 of the ladder-lock buckle and a first stitching 130 applied, thereby restricting one side of the ladder-lock buckle in a fixed location on the linear strap 116. The apparatus 110 is then place on the cover 112 mounted over the seating or resting device 114 and the right end 122R of the linear strap 116 is looped through the cinching apertures 132A and 132B of the ladder-lock buckle, and pulled until the apparatus 110 is tautly securing the cover 112 on the seating or resting device 114. To release the tension on the linear strap 116, the buckle tab is lifted letting the linear strap 116 pass back through the cinching apertures 132A and 132B.

In another embodiment (FIG. 1A), the variable coupling means 118 further comprises a first complimentary releasable coupling component and a second complimentary releasable coupling component, wherein the left end 122L (i.e., the left free end) of the linear strap 116 is threaded through a first strap adjusting aperture of the first complimentary releasable coupling component and the right end 122R (i.e., the right free end) of the linear strap 116 is threaded through a second strap adjusting aperture of the second complimentary releasable coupling mean. The first complimentary releasable coupling component and the second releasable complimentary coupling component are positioned on the linear strap 116 between the first fastening means 120L and the second fastening means 120R being displaced relative to each other such that the apparatus 110 is taut around the cover 112 mounted on the seating or resting device 114 when the first complimentary releasable coupling component and the second releasable complimentary coupling component are coupled (i.e., engaged).

Figure 3:
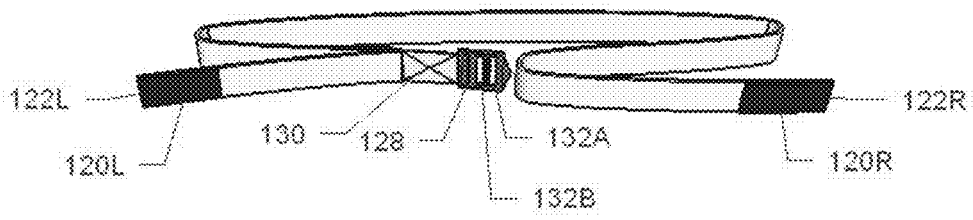
Figure 4:
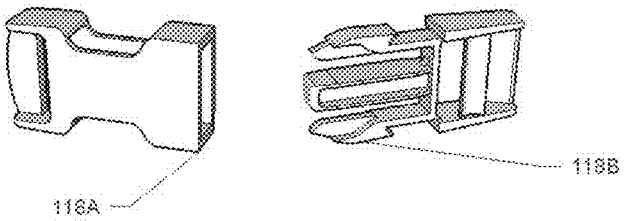

The variable coupling means 118 is comprised of various compositions including metal, plastic, nylon strap loop, etc.). In one embodiment, the variable coupling means 118 is the ladder lock fastener comprised of plastic (FIG. 3). In another embodiment, the variable coupling means 118 further comprises the first complimentary releasable coupling component 118A and the second releasable complimentary coupling component 118B of the variable coupling means 118 wherein the complimentary releasable components of the variable coupling means 118 are respective a male component 134A and a female component 134B of an adjustably releasable buckle (FIG. 1A and FIG. 4). In yet another embodiment, the adjustably releasable buckle is plastic.

Operation

In one embodiment, a manner of using the apparatus 110 (FIG. 1C) is (1) placing the cover 112 on the seating or resting device 114, (2) positioning the apparatus 110 on the cover 112, (3) passing the first end 122L and the second end 122R of the linear strap 116 around to the rear side of the seating or resting device 114, (4) adjusting the complimentary components of the variable coupling means 118 to positions on the linear strap 116 where engagement of the complimentary components of the variable coupling means 118 will result in taut fitting of the apparatus 110, and (5) engaging the complimentary components of the variable coupling means 118.

In another embodiment, a manner of using the apparatus 110 (FIG. 1B) is: (1) placing the apparatus 110 on a surface, (2) rolling up the cover 112 with any personal items contained therein, (3) placing the cover 112 in a rolled up configuration on the linear strap 116 in the region of the linear strap 116 starting about 12 inches from the left end 122L to near the middle of the apparatus 110, (3) wrapping the portion of the linear strap 116 around the cover 112 starting where the cover 112 was placed on the linear strap 116 to the first end 122L, (4) engaging the first fastening means 120L with the linear strap 116, and (5) folding the free strap portion (i.e., the portion of the linear strap 116 where the cover 112 was placed to the second end 122R) so as to locate the second fastening means 120R near the linear strap 116, and engaging the second fastening means 120R with the linear strap 116 to form to form a loop for hands-free transporting (e.g., by over the arm or shoulder).

Stabilizing Pad 116M

Figure 5:
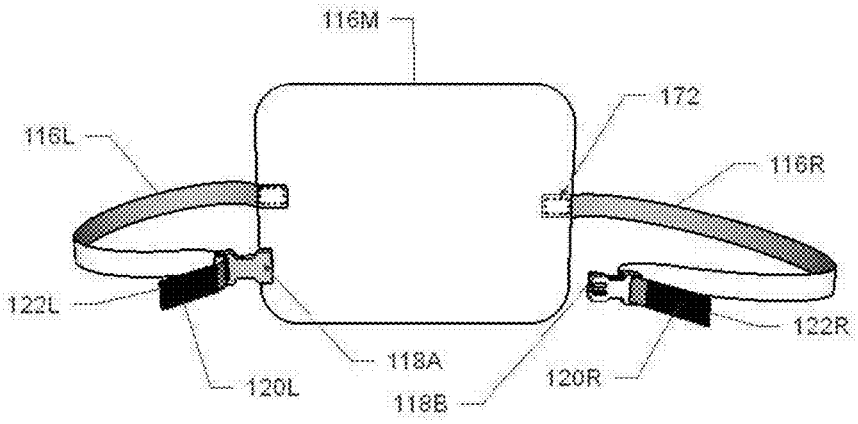

In another embodiment (FIG. 5), the linear strap 116 further comprises a left strap 116L, a stabilizing pad 116M, and a right strap 116R. The stabilizing pad 116M is generally rectangular in shape having a right vertical perimeter 136, a left vertical perimeter 138, a top horizontal perimeter 140, and a bottom horizontal perimeter 142. Length of the stabilizing pad 116M from the right vertical perimeter 136 to the left vertical perimeter 138 is about is 12 inches to 26 inches, or about 14 inches to 24, or 16 inches to 24, or 16 inches to 22 inches. Width of the stabilizing pad 116M from the top horizontal perimeter 140 to the bottom horizontal perimeter 142 is about 10 inches to about 16 inches, or about 12 inches to about 14 inches. Additionally, the stabilizing pad 116M has a front side 144 (a.k.a., the front rectangular side facing an occupant of the resting or seating device 114), and a rear side 146 (a.k.a., a rear rectangular side secured against the resting or seating device 114).

Single-Ply and Multi-Layer

Figure 6:
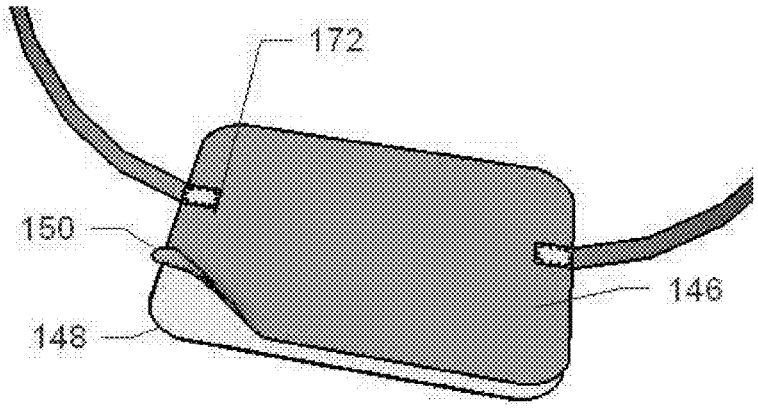

In one embodiment, the stabilizing pad 116M comprises one or more layers of a single ply fabric comprising a natural fiber (e.g., cotton, linen silk, wool), a synthetic fiber (e.g., polyester, nylon, rayon, acrylic, polypropylene, polyethylene, or some combination thereof), or a combination of natural and synthetic fibers. In another embodiment, the single ply fabric is produced by known knitting or weaving methods (e.g., plain, satin, twill) to enhance, for example, absorbency and stretchability while reducing, for example, weight, and tendency to wrinkle. In another embodiment, the single ply fabric is woven fabric to enhance, for example, the durability and printability. In yet another embodiment (FIG. 6), the stabilizing pad 116M further comprises a top layer 148 comprising one or more layers of the single ply fabric and a bottom layer 150 comprising one or more layers of the single ply fabric. In still another embodiment, the top layer 148 and the bottom layer 150 comprise one or more fabrics comprising a natural fiber, a synthetic fiber, or a combination of natural and synthetic fiber and further comprising a canvas or denim weaving pattern thereby imparting the stabilizing pad 116M with exceptional properties such as strength, durability and printability.

Batting/Filling/Wadding

Figure 7:
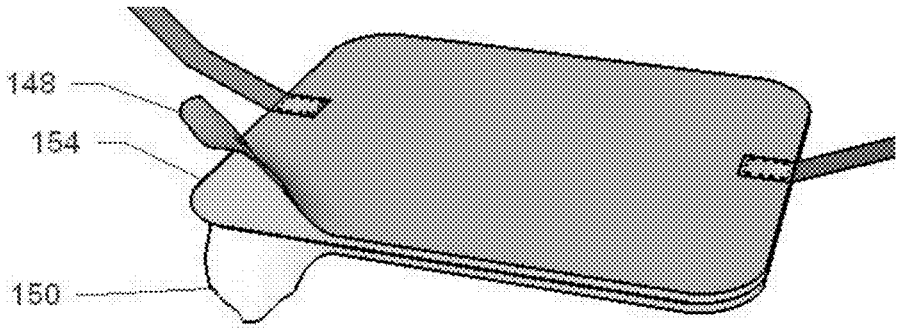

In another embodiment (FIG. 7), the stabilizing pad 116M further comprises one or more layers of a batting layer 154 sandwiched between the top layer 148 and the bottom layer 150. The batting layer 154 is comprised of fibers, including cotton, polyester, cotton blend, and bamboo, and combinations thereof.

Outer Perimeter Securing Means

Figure 8:
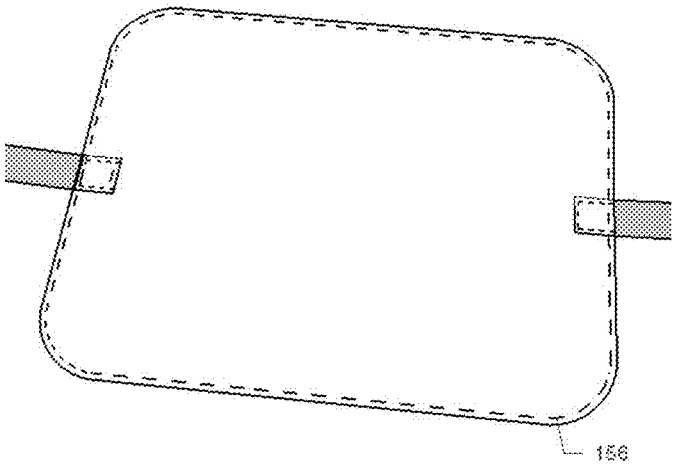
Figure 9:
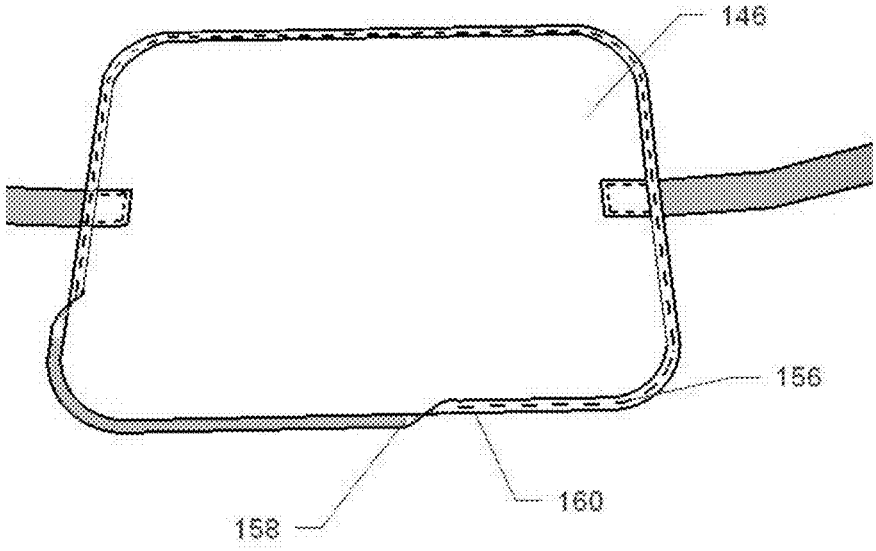

In another embodiment (FIG. 8), the stabilizing pad 116M comprises an outer perimeter securing means 156 (e.g., such as stitching, adhesive, or hot glue) adjacent to the outer perimeter of the stabilizing pad 116M for preventing the fabric of the body from fraying and for insuring the one or more layer of the fabric and the batting of the stabilizing pad 116M remain together as a single member. The outer perimeter securing means 156 is about 1 inch from the outer perimeter of the stabilizing pad 116M, or about 0.75 inch from the outer perimeter of the stabilizing pad 116M, or about 0.5 inch from the outer perimeter of the stabilizing pad 116M, or about 0.25 inch from the outer perimeter of the stabilizing pad 116M. The outer perimeter of the stabilizing pad 116M is defined herein to be the sum of the right vertical perimeter 136, the left vertical perimeter 138, the top horizontal perimeter 140, and the bottom horizontal perimeter 142. In another embodiment (FIG. 9), an outer perimeter area 158 (a.k.a., a hem) comprising about 0.25 inches to about 0.5 inches of the outer perimeter area of the stabilizing pad 116M is folded inward onto the stabilizing pad 116M producing an outer perimeter crease 160, wherein the outer perimeter area, or the hem, 158 of the stabilizing pad 116M extending inward from the outer perimeter crease 160 is secured to the stabilizing pad 116M by the outer perimeter securing means 156. The outer perimeter area 158, or hem, is secured to the front side 144 or the rear side 146 of the stabilizing pad 116M.

Welt, or Binding or Piping

Figure 10:
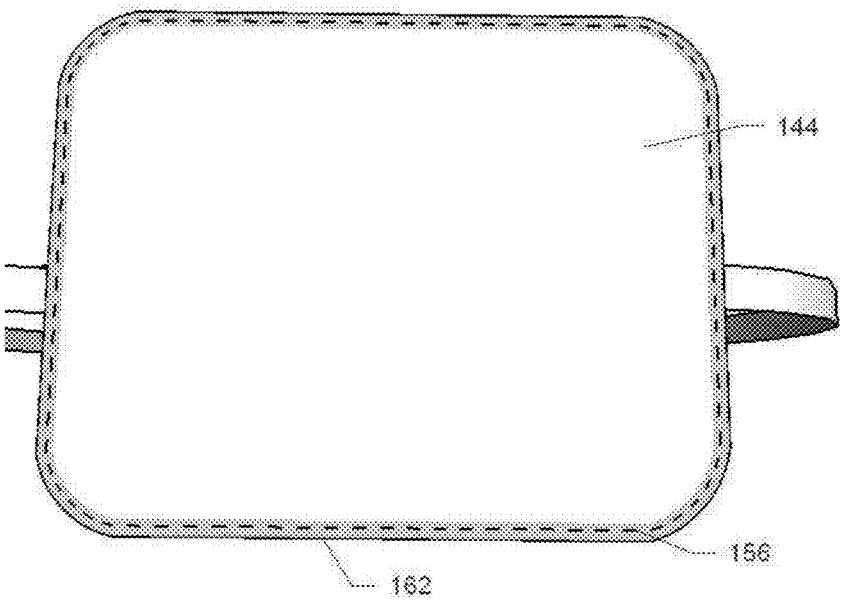

In another embodiment (FIG. 10), the stabilizing pad 116M comprises a welt 162 (a.k.a., binding or piping) folded around the outer perimeter of the stabilizing pad 116M wherein the outer perimeter securing means 156 secures the welt 162 to the stabilizing pad 116M. The welt 162 is about 0.5 inches to about 1 inch wide and of a length equal, or slightly longer, than the perimeter of the stabilizing pad 116M. The welt 162, is oriented longitudinally around the perimeter of the stabilizing pad 116M and folded over the outer perimeter (a.k.a., outer circumference) of the stabilizing pad 116M wherein about half of the welt 162 is laterally folded over the outer perimeter of the stabilizing pad 116M onto the front side 144 of the stabilizing pad 116M and about half of the width of the welt 162 is folded onto the rear side 146 of the stabilizing pad 116M. The welt 162 can be the same fabric as used for the top single-ply fabric, the bottom single-ply fabric, the top layer 148, the bottom layer 150, or another fabric exhibiting enhanced properties, such as, enhanced wear, color contrast, stiffness, aesthetics, etc. In one embodiment, the welt 162 is secured to the outer perimeter of the stabilizing pad 116M with the outer perimeter securing means 156 comprising stitching. In yet another embodiment, the welt 162 is secured to the perimeter of the stabilizing pad 116M with the outer perimeter securing means 156 comprising an adhesive. In yet another embodiment, the welt 162 is secured to the perimeter of the stabilizing pad 116M with the outer perimeter securing means 156 comprising a hot-glue adhesive.

Two Layer with Filling and Quilted

Figure 11:
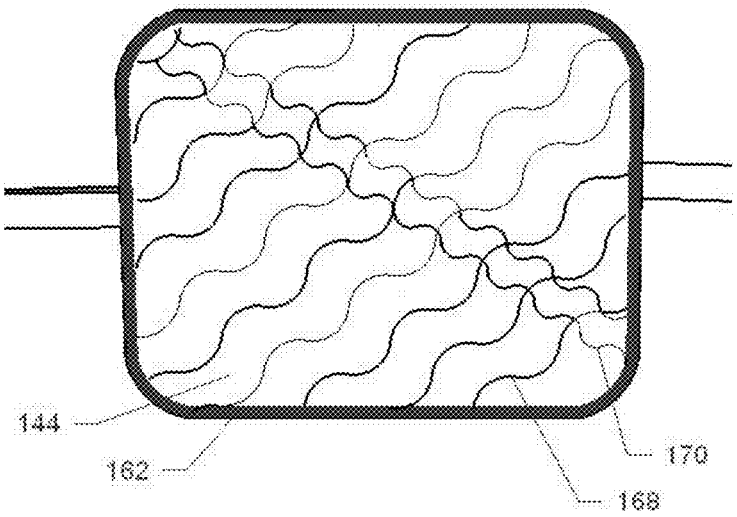

In yet another embodiment (FIG. 11), the stabilizing pad 116M further comprises a first quilt stitching 168 securing together the top layer 148, the batten layer 154 and the bottom layer 150. The first quilt stitching 168 (FIG. 11) comprises stitching in one or more straight lines, curved lines, or a combination thereof, wherein the lines are biased, for example, the lines separated by about 0.25 inches to about 3 inches, or about 0.5 to about 2.5 inches, or about 1 to about 2 inches. In another embodiment, the stabilizing pad 116M comprises a second quilt sticking 170 displaced (e.g., radially or diagonal to the first quilt stitching) from the first quilt stitching 168.

Adhesive Layer

Figure 12:
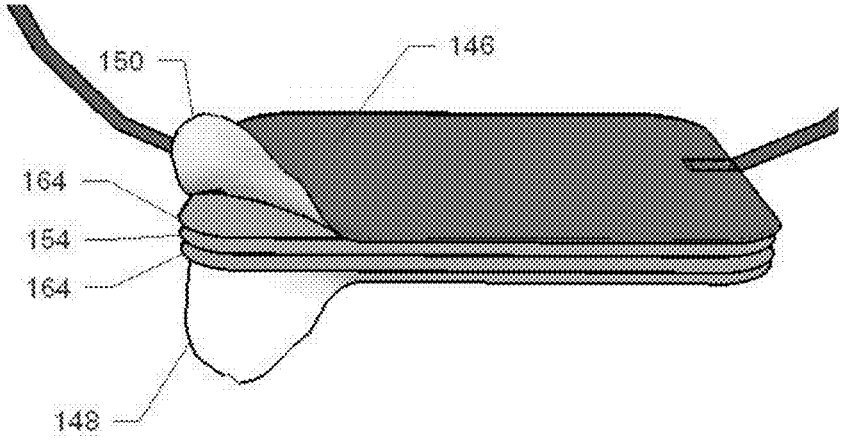
Figure 13:
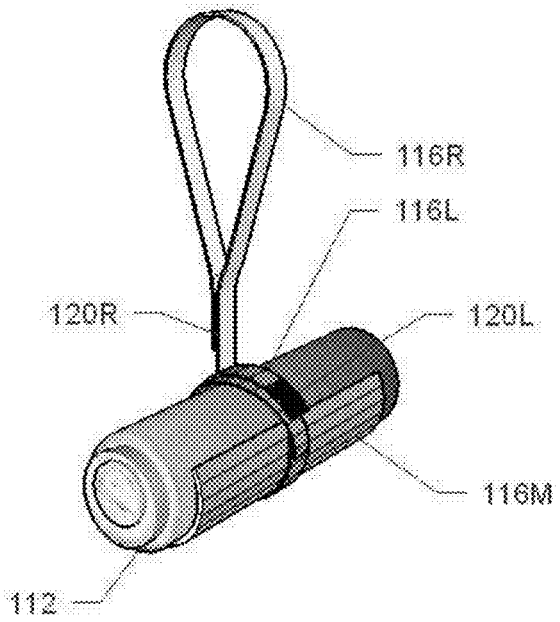
Figure 14:
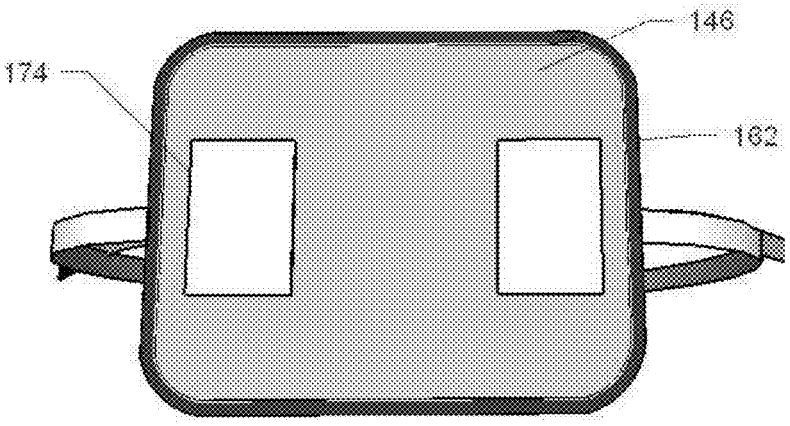

In another embodiment (FIG. 12), the stabilizing pad 116M comprises a combination of one or more of an adhesive resin to form an adhesive layer 164 for assembling and securing the stabilizing pad 116M comprising multiple layers (e.g., the top layer 148, the batten layer 154, and the bottom layer 150) of the stabilizing pad 116M as a single member. The adhesive layer 164 improves the stiffness and shape retention of the stabilizing pad 116M. As such, the stabilizing pad 116M will lie flat and not wrinkle. Exemplary adhesive resins include low melting temperature copolyester resins made by EMS-CHEMIE Inc. (a.k.a., Griltex® 9) and higher melt temperature copolyester resins made by EMS-CHEMIE Inc. (a.k.a., Griltex® D 1377E). The adhesive resins can be applied by means of a roll glue coating machine, such as that made by 2M in Quebec Canada. Other application machines, known to those skilled in the art, can also be used to apply the resins. Alternatively, the adhesive resin can be applied in powder form by dusting or by spray or soaking in liquid form. After the adhesive resin is applied, the top layer 148, the bottom layer 150 and the batten layer 154 are cut to size and placed adjacent to one another as defined by their cut shape. In certain embodiments, the outer perimeter securing means 156 is used to help maintain proper alignment and bonding between the top layer 148, the bottom layer 150, and additional layers (e.g., the batten layer 154) comprising the stabilizing pad 116M. Heat (375-425° F.) and pressure (60-80 PSI) is applied to the stabilizing pad 116M for 10-20 seconds to form a bond between the multiple layers thereby producing the stabilizing pad 116M whereby multiple layers adhere together as the single member.

In another embodiment, the stabilizing pad 116M will comprise one or more layers of single-ply fabric, one or more of the batting layer, and an outer perimeter securing means of stitching. In this embodiment, the number of single-ply fabric and batting layer will be such that the thickness of the stabilizing pad 116M is capable of being dried by generally acceptable times required for personal clothing using generally accepted drying methods and equipment. The thickness of the stabilizing pad 116M will between about 0.0625 inches and about 1 inches, or between about 0.125 inches and about 0.375, inches, less than about 0.75 inches, or less than about 0.5 inches, or less than about 0.375 inches, or less than about 0.250 inches.

In yet another embodiment, the translational friction between the stabilizing pad 116M and the cover 112 may be enhanced to improve the effectiveness of the stabilizing pad 116M. For example, tabs of webbing comprising the hook 124 as described above for the first fastening means 122L and the second fastening means 122R may be sewn to the rear of the stabilizing pad 116M.

Operation, Linear Strap Comprising Stabilization Pad

A manner of using the apparatus 110 of this embodiment (FIG. 12) is: (1) placing the apparatus 110 on a surface, (2) rolling up the cover 112 with any personal items within the cover 112, (3) placing the cover 112 on the stabilizing pad 116M of the apparatus 110, (3) rolling the stabilizing pad 116M of the apparatus 110 around the cover 112, (4) tautly wrapping the left strap 116L around the cover 112, (5) engaging the hook 126 of the first fastening means 120L with the loop 126 of the left strap 116L to secure the cover 112 in a rolled up configuration, and (6) forming and a transporting an aperture (i.e., the closed-loop for arm or shoulder sling) sized for hands-free carrying (e.g., by forearm or over the shoulder) by engaging the hook 126 of the second fastening means 120R with the loop 126 of the right strap 116R.

Strap-to-Stabilizing Pad Attachment Means

In another embodiment, the apparatus 110 comprises a strap-to-pad attachment means for attaching the left strap 116L and the right strap 116R to the stabilizing pad 116M. The strap-to-pad attachment means can be a permanent attachment means (e.g., sewing, stitch, brad) or can be a releasably attachable means (e.g., snaps, hook-and-loop fasteners, loop-and-eye fasteners, button, etc.) enabling the left strap 116L and the right strap 116R to be detached from the stabilizing pad 116M, Removal of the left strap 116L and the right strap 116R from the stabilizing pad 116M is advantageous when the apparatus 110 is exposed to detrimental conditions, such as environmentally degrading conditions (e.g., high temperatures of washer and dryer).

Printed Image

In another embodiment, the stabilizing pad 116M comprises an embroidered or printed image on the front side 144 of the stabilizing pad 116M. In this embodiment, the top layer 148 (a.k.a., a print receiving layer) of the stabilizing pad 116M comprises a single-ply fabric of polyester, cotton, or blend of polyester and cotton providing enhanced print receiving properties. The print receiving layer is cut and pre-shrunk by the application of a heat process of 375-425 degrees F. for 10-20 seconds at 60-80 psi. The printed image is then applied to the print receiving layer by, for example, a sublimation printing process. The print receiving layer is cut to dimensions of the stabilizing pad 116M. When the stabilizing pad 116M comprises multiple layers, the print receiving layer (a.k.a., the top layer) 148 is cut to be congruent and conform with the shape of the bottom layer 150. The top layer (a.k.a., print receiving layer) 148 and the bottom layer 150 of the stabilizing pad 116M are secured together by the outer perimeter securing means 156. The first quilt stitching 168 and the second quilt stitching 170 may be applied to secure the top layer (a.k.a., print receiving layer) 148 to the rear side 146, as well as to secure any of the batting layer 154 (a.k.a., batten) incorporated into the stabilizing pad 116M.

The print image is desire for several reasons including reservation and identification of a seating or resting device, cover mounted on the seating or resting device, or personal items stored in the cover, for example, at the beach or pool side. In at least one embodiment, the apparatus 110 can be easily stored in a handbag when not in use and when needed can be unfolded for placement over the cover 112 to be mounted on the seating or resting device 114 (e.g., lounge chair).

Pocket

In an embodiment, the stabilizing pad 116M of the apparatus 110 comprises a pocket (a.k.a., a pouch) 174 comprising a sheet of cloth, canvas, or other similar fabric material, which has been folded and stitched together in such a way as to define a cavity bounded by a front portion, a rear portion, a bottom edge, a left edge, a right edge, and an open top, sized and shaped to removably receive there within small items (e.g., sunglasses, a wallet, phone, radio, hotel key, identification cards, credit cards, paper money, Bluetooth or GPS tracking tag, and the like) through the open top. In another embodiment, the apparatus 110 comprises the pocket 174 on the rear side 146 of the stabilizing pad 116M. In another embodiment, the pocket 174 is on the front side 144 of the stabilizing pad 116M. In still another embodiment, the apparatus 110 comprises the pocket 174 wherein the pocket 174 opening comprises a reversibly closeable means for securing items stored within the pocket 174; the reversibly closeable means comprising for example a button, snap, zipper, or hook-and-loop, or other fasteners. In yet another embodiment, the apparatus 110 comprises the pocket 174 wherein the cloth, canvas, or other similar fabric material defining the cavity of the pocket 174 has been treated by methods and chemicals known in the art to make a pocket 174 waterproof.

ADVANTAGES

Accordingly, several advantages of one or more aspects are as follows:

The apparatus 110 comprises a simple, unitary strap providing dual functionality for facilitating transporting a cover 112 (e.g., towel) and securing the cover 112 to a seating or resting device 114 (e.g., a chair, a beach chair, lawn chair, lounge chair, chaise chair, stool, etc.).

The apparatus 110 wherein dual functionalities are adaptable to various sizes of the cover 112 and the seating of resting device 114.

The apparatus 110 can be clean utilizing equipment and conditions typical of traditional clothing.

The apparatus 110 wherein dual functionalities are removable when the apparatus 110 must be exposed to detrimental environments.

These and other advantages of the present invention will be apparent to those skilled in the art from the foregoing specification. Accordingly, it will be recognized by those skilled in the art that changes or modifications may be made to the above-described embodiments without departing from the broad inventive concepts of the inventions. It should therefore be understood that the inventions are not limited to the particular embodiments described herein, but are intended to include all changes and modifications that are within the scope and spirit of the inventions as set forth in the claims.

I claim:

1. An apparatus for transporting a cover and for securing said cover to a seating or resting device comprising:

a) a linear strap, wherein said linear strap further comprising:
   i) a left strap,
   ii) a stabilizing pad, wherein said stabilizing pad further comprises a first quilt stitching and a second quilt stitching, and
   iii) a right strap,
b) a first fastening means for engaging a first end of said linear strap to said linear strap to form a first closed-loop of variable size to secure towel during transportation,
c) a second fastening means for engaging a second end of said linear strap to said linear strap to form a second closed-loop of variable size for use as a transportation sling, and
d) a variable coupling means for configuring said linear strap into a third closed-loop of variable size for securing said cover disposed on said seating or resting device.

2. An apparatus for transporting a cover and for securing said cover to a seating or resting device comprising:
a) a linear strap, wherein said linear strap further comprises:
   i) a left strap,
   ii) a stabilizing pad, wherein said stabilizing pad further comprises an adhesive layer, and
   iii) a right strap,
b) a first fastening means for engaging a first end of said linear strap to said linear strap to form a first closed-loop of variable size to secure towel during transportation,
c) a second fastening means for engaging a second end of said linear strap to said linear strap to form a second closed-loop of variable size for use as a transportation sling, and
d) a variable coupling means for configuring said linear strap into a third closed-loop of variable size for securing said cover disposed on said seating or resting device.

3. An apparatus for transporting a cover and for securing said cover to a seating or resting device comprising:
a) a linear strap, wherein said linear strap further comprises:
   i) a left strap,
   ii) a stabilizing pad,
   iii) a right strap, and
   iv) a strap-to-body attachment means wherein said strap-to-body attachment means is a sewing thereby providing permanent attachment of said left strap and said right strap to said stabilizing pad, whereby said left strap, said stabilizing pad, said right strap, and is of one-piece, integral, and unitary construction,
b) a first fastening means for engaging a first end of said linear strap to said linear strap to form a first closed-loop of variable size to secure towel during transportation,
c) a second fastening means for engaging a second end of said linear strap to said linear strap to form a second closed-loop of variable size for use as a transportation sling, and
d) a variable coupling means for configuring said linear strap into a third closed-loop of variable size for securing said cover disposed on said seating or resting device.

4. An apparatus for transporting a cover and for securing said cover to a seating or resting device comprising:
a) a linear strap, wherein said linear strap further comprises:
   i) a left strap,
   ii) a stabilizing pad,
   iii) a right strap, and
   iv) a strap-to-body attachment means wherein said strap-to-body attachment means is a releasably attachable means for providing releasable attachment of said left strap and said right strap from said stabilizing pad whereby said left strap, said stabilizing pad, said right strap, and is of one-piece, integral, and unitary construction,
b) a first fastening means for engaging a first end of said linear strap to said linear strap to form a first closed-loop of variable size to secure towel during transportation,
c) a second fastening means for engaging a second end of said linear strap to said linear strap to form a second closed-loop of variable size for use as a transportation sling, and
d) a variable coupling means for configuring said linear strap into a third closed-loop of variable size for securing said cover disposed on said seating or resting device.

5. Said apparatus of claim 4 wherein said releasably attachable means is a button snap thereby providing releasable attachment of said left strap and said right strap from said stabilizing pad.

* * * * *